US010565933B2

(12) United States Patent
Zheng

(10) Patent No.: US 10,565,933 B2
(45) Date of Patent: Feb. 18, 2020

(54) PIXEL CIRCUIT, DRIVING METHOD THEREOF, ARRAY SUBSTRATE, DISPLAY DEVICE

(71) Applicant: BOE TECHNOLOGY GROUP CO., LTD., Beijing (CN)

(72) Inventor: Can Zheng, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 24 days.

(21) Appl. No.: 15/765,709

(22) PCT Filed: Sep. 22, 2017

(86) PCT No.: PCT/CN2017/102890

§ 371 (c)(1),
(2) Date: Apr. 3, 2018

(87) PCT Pub. No.: WO2018/054350

PCT Pub. Date: Mar. 29, 2018

(65) Prior Publication Data

US 2018/0286313 A1 Oct. 4, 2018

(30) Foreign Application Priority Data

Sep. 26, 2016 (CN) ..... 2016 1 0853395

(51) Int. Cl.
*G09G 5/00* (2006.01)
*G09G 3/3258* (2016.01)
(Continued)

(52) U.S. Cl.
CPC ..... *G09G 3/3258* (2013.01); *G09G 3/3233* (2013.01); *G09G 3/3266* (2013.01);
(Continued)

(58) Field of Classification Search
CPC .. G09G 3/3258; G09G 3/3266; G09G 3/3233; G09G 2310/0202;
(Continued)

(56) References Cited

U.S. PATENT DOCUMENTS

2013/0106828 A1 5/2013 Kim
2015/0269890 A1* 9/2015 Ma ..... G09G 3/3291 345/215
(Continued)

FOREIGN PATENT DOCUMENTS

CN 102651196 A 8/2012
CN 103236237 A 8/2013
(Continued)

OTHER PUBLICATIONS

Office Action received for Chinese Patent Application No. 201610853395.9, dated May 27, 2017, 9 pages (4 pages of English Translation and 5 pages of Office Action).
(Continued)

*Primary Examiner* — Adam R. Giesy
(74) *Attorney, Agent, or Firm* — Womble Bond Dickinson (US) LLP

(57) ABSTRACT

The present disclosure provides a pixel circuit, a driving method thereof, an array substrate and a display device. The pixel circuit comprises: a driving transistor; a precharge sub-circuit configured to write a supply voltage into a first node under the control of a scan signal and a light emission control signal in a precharge phase; a reset sub-circuit; a data writing sub-circuit configured to write a data voltage into the first node under the control of the scan signal in a data writing phase, so that the potential of the first node is equal to a sum of the data voltage and a threshold voltage of the driving transistor; a light emission control sub-circuit configured to connect a power supply with a light-emitting unit through the driving transistor under the control of the light emission control signal in a light-emitting phase.

19 Claims, 3 Drawing Sheets

(51) Int. Cl.
*G09G 3/3266* (2016.01)
*G09G 3/3233* (2016.01)

(52) U.S. Cl.
CPC ..... *G09G 2310/0202* (2013.01); *G09G 2310/0243* (2013.01); *G09G 2310/0264* (2013.01); *G09G 2310/08* (2013.01)

(58) Field of Classification Search
CPC ..... G09G 2310/0243; G09G 2310/08; G09G 2310/0264; G09G 2310/0248; G09G 2310/0251
See application file for complete search history.

(56) References Cited

U.S. PATENT DOCUMENTS

2015/0339974 A1 11/2015 Wu et al.
2015/0339976 A1 11/2015 Tsai et al.
2016/0351125 A1 12/2016 Zhou
2016/0358546 A1 12/2016 Ma
2017/0249904 A1* 8/2017 Li ..... G09G 3/3233

FOREIGN PATENT DOCUMENTS

CN 104157244 A 11/2014
CN 104485074 A 4/2015
CN 104637446 A 5/2015
CN 104680976 A 6/2015
CN 104715723 A 6/2015
CN 106297667 A 1/2017

OTHER PUBLICATIONS

International Search Report received for PCT Patent Application No. PCT/CN2017/102890, dated Dec. 27, 2017, 6 pages (2 pages of English Translation and 4 pages of Original Document).

* cited by examiner

PIXEL CIRCUIT, DRIVING METHOD THEREOF, ARRAY SUBSTRATE, DISPLAY DEVICE

RELATED APPLICATION

The present application is the U.S. national phase entry of PCT/CN2017/102890, with an international filing date of Sep. 22, 2017, which claims the benefit of Chinese Patent Application No. 201610853395.9, filed on Sep. 26, 2016, the entire disclosure of which is incorporated herein by reference.

FIELD

The present disclosure relates to the field of semiconductor technologies, and particularly to a pixel circuit, a driving method thereof, an array substrate, and a display device.

BACKGROUND

At present, displays are mainly divided into two types, including thin film transistor-liquid crystal displays (TFT-LCD) and organic light-emitting diode (OLED) displays.

Unlike a TFT-LCD, which controls brightness of display using voltage, an OLED display is current-driven and requires a stable current to control brightness of the OLED. During operation, the OLED display controls the brightness of OLED through a pixel circuit.

For example, a conventional 2T1C (2 transistors and 1 capacitor) pixel circuit comprises a switching transistor T1, a driving transistor T2, and a storage capacitor Cs. A control terminal of T1 is connected to a gate line, a first terminal of T1 is connected to a data line, and a second terminal of T1 is connected to a control terminal of T2. A first terminal of T2 is connected to a supply voltage Vdd, and a second terminal of T2 is connected to an anode of an OLED. A cathode of the OLED is grounded. The storage capacitor Cs is connected in parallel between the control terminal and the second terminal of T2. When scanning of a current pixel is started, and a voltage Vgate provided by the gate line is at a low level (based on an example in which the switching transistor T1 is a P-type transistor), T1 is turned on to write a data voltage Vdata provided through the data line into the storage capacitor Cs. When the scanning ends, Vgate becomes high and T1 is turned off T2 is turned on by the data voltage stored in Cs, thereby driving the OLED to emit light. A driving current of T2, i.e. an operating current of the OLED, can be expressed as $I_{OLED}=K(Vgs-Vth)^2$, wherein Vgs is a gate-source voltage of T2, Vth is a threshold voltage of T2, and K is a coefficient, specifically $K=\mu CoxW/(2L)$, where p is a carrier mobility, Cox is a gate potential area capacitance, and W and L are a channel width and a channel length of T2, respectively.

Due to the process procedure, device aging and other reasons, the threshold voltages Vths of the driving TFTs of respective pixel points would be different, and voltage drift would be generated with use. As a result, even if the same gate-source voltage Vgs is applied to the driving transistor, the generated current $I_{OLED}$ would vary with Vth, thus affecting the uniformity of display.

SUMMARY

Embodiments of the present disclosure provide a pixel circuit, a driving method thereof, an array substrate and a display device.

In an aspect, embodiments of the present disclosure provide a pixel circuit. The pixel circuit comprises:

a driving transistor;

a precharge sub-circuit configured to write a supply voltage into a first node under the control of a scan signal and a light emission control signal in a precharge phase, the first node being connected to a control terminal of the driving transistor;

a reset sub-circuit configured to decrease a potential of the first node under the control of a reference signal in a reset phase;

a data writing sub-circuit configured to write a data voltage into the first node under the control of the scan signal in a data writing phase so that the potential of the first node is equal to a sum of the data voltage and a threshold voltage of the driving transistor;

a light emission control sub-circuit configured to connect a power supply with a light-emitting unit through the driving transistor under the control of the light emission control signal in a light-emitting phase.

In an example implementation of the embodiments of the present disclosure, the precharge sub-circuit comprises a first transistor and a second transistor. A control terminal of the first transistor is connected to a light emission control line, a first terminal of the first transistor is connected to a power line, and a second terminal of the first transistor is connected to a first terminal of the driving transistor. A control terminal of the second transistor is connected to a gate line, a first terminal of the second transistor is connected to the first terminal of the driving transistor, and a second terminal of the second transistor is connected to the control terminal of the driving transistor. The light emission control line is configured to output the light emission control signal, the power line is configured to output the supply voltage of the power supply, and the gate line is configured to output the scan signal.

In an example implementation of the embodiments of the present disclosure, the reset sub-circuit comprises a capacitor. One pole of the capacitor is connected to a control terminal of the driving transistor, and the other pole of the capacitor is connected to a reference signal line, the reference signal line being configured to output the reference signal.

In an example implementation of the embodiments of the present disclosure, the data writing sub-circuit comprises a third transistor and a fourth transistor. A control terminal of the third transistor is connected to a gate line, a first terminal of the third transistor is connected to a data line, and a second terminal of the third transistor is connected to a second terminal of the driving transistor. A control terminal of the fourth transistor is connected to the reference signal line, a first terminal of the fourth transistor is connected to the second terminal of the driving transistor, and a second terminal of the fourth transistor is connected to the light emission control sub-circuit. The data line is configured to output the data voltage.

In an example implementation of the embodiments of the present disclosure, the light emission control sub-circuit comprises a fifth transistor. A control terminal of the fifth transistor is connected to a light emission control line, a first terminal of the fifth transistor is connected to the second terminal of the fourth transistor, and a second terminal of the fifth transistor is connected to the light-emitting unit.

In an example implementation of the embodiments of the present disclosure, the first transistor, the second transistor, the third transistor, the fourth transistor, the fifth transistor, and the driving transistor are thin films transistors.

In an example implementation of the embodiments of the present disclosure, in each cycle, the scan signal includes two pulses. The former of the two pulses is configured to control the precharge sub-circuit to write the supply voltage into the first node, and the latter of the two pulses is configured to control the data writing sub-circuit to write the data voltage into the first node. Each cycle includes the precharge phase, the reset phase, the data writing phase, and the light-emitting phase.

In an example implementation of the embodiments of the present disclosure, in each cycle, the light emission control signal includes one pulse. The pulse is configured to control the light emission control sub-circuit to connect the power supply with the light-emitting unit through the driving transistor. Each cycle includes the precharge phase, the reset phase, the data writing phase, and the light-emitting phase.

In another aspect, embodiments of the present disclosure further provide an array substrate comprising multiple rows of any of the pixel circuits described above.

In an example implementation of the embodiments of the present disclosure, a light emission control line of a pixel circuit of an N-th row is connected to a reference signal line of a pixel circuit of an (N+1)-th row, N being a positive integer.

In yet another aspect, embodiments of the present disclosure further provide a display device comprising any of the array substrates described above.

In still another aspect, embodiments of the present disclosure further provide a pixel circuit driving method for driving the pixel circuit described above. The method comprises:

in the precharge phase, writing the supply voltage into the first node under the control of the scan signal and the light emission control signal, the first node being connected to the control terminal of the driving transistor;

in the reset phase, decreasing the potential of the first node under the control of the reference signal;

in the data writing phase, writing the data voltage into the first node under the control of the scan signal so that the potential of the first node is equal to the sum of the data voltage and the threshold voltage of the driving transistor;

in the light-emitting phase, connecting the power supply with the light-emitting unit through the driving transistor under the control of the light emission control signal.

In an example implementation of the embodiments of the present disclosure, in each cycle, the scan signal includes two pulses. The former of the two pulses is configured to write the supply voltage into the first node, and the latter of the two pulses is configured to write the data voltage into the first node. Each cycle includes the precharge phase, the reset phase, the data writing phase, and the light-emitting phase.

In a further aspect, embodiments of the present disclosure provide an array substrate driving method for driving the array substrate described above. The method comprises driving the pixel circuits of the array substrate row by row using the pixel circuit driving method described above.

In an example implementation of the embodiments of the present disclosure, a light emission control signal of a pixel circuit of an N-th row and a reference signal of a pixel circuit of an (N+1)-th row are the same signal, N being a positive integer.

In an example implementation of the embodiments of the present disclosure, in each cycle, the scan signal includes two pulses. The former of the two pulses is configured to write the supply voltage into the first node, and the latter of the two pulses is configured to write the data voltage into the first node. Each cycle includes the precharge phase, the reset phase, the data writing phase, and the light-emitting phase.

BRIEF DESCRIPTION OF DRAWINGS

To illustrate the technical solutions in embodiments of the present disclosure more clearly, the accompanying drawings required for describing the embodiments will be briefly introduced below. Apparently, the accompanying drawings in the description below show merely some embodiments of the present disclosure. For those ordinarily skilled in the art, other drawings can also be obtained based on these drawings without spending inventive efforts.

DETAILED DESCRIPTION

To make the objectives, technical solutions, and advantages of the present disclosure more comprehensible, example implementations of the present disclosure will be further described in detail below with reference to the accompanying drawings.

Figure 1:
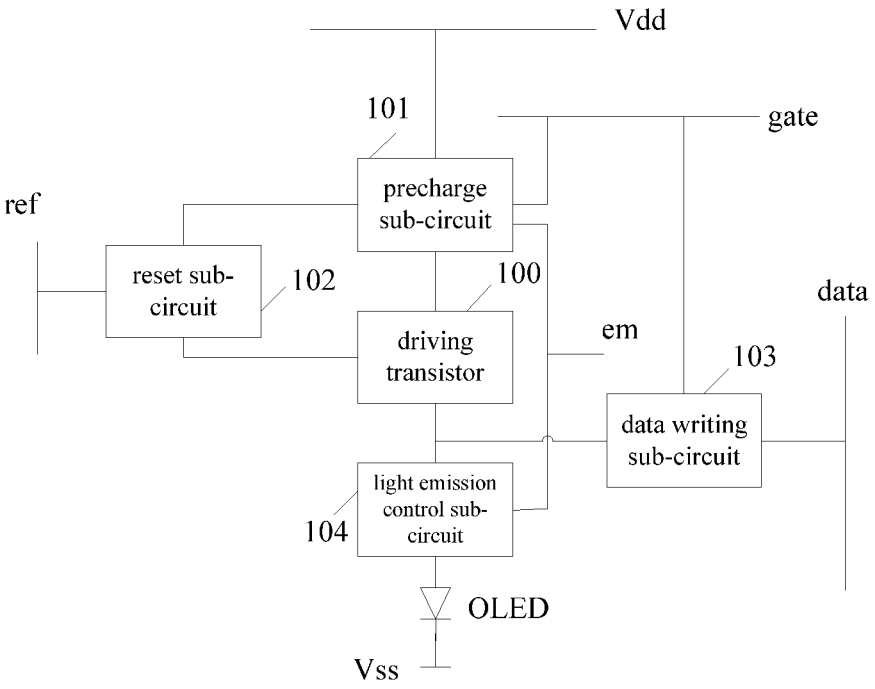
FIG. 1 is a schematic structural diagram of a pixel circuit provided by embodiments of the present disclosure.

Embodiments of the present disclosure provide a pixel circuit for driving an organic light-emitting diode to emit light. Referring to FIG. 1, the pixel circuit comprises a driving transistor 100, a precharge sub-circuit 101, a reset sub-circuit 102, a data writing sub-circuit 103, and a light emission control sub-circuit 104.

The precharge sub-circuit 101 is configured to write a supply voltage into a first node under the control of a scan signal and a light emission control signal in a precharge phase, and the first node is connected to a control terminal of the driving transistor 100. The reset sub-circuit 102 is configured to decrease a potential of the first node under the control of a reference signal in a reset phase. The data writing sub-circuit 103 is configured to write a data voltage into the first node under the control of the scan signal in a data writing phase so that the potential of the first node is equal to a sum of the data voltage and a threshold voltage of the driving transistor 100. The light emission control sub-circuit 104 is configured to connect a power supply with a light-emitting unit OLED through the driving transistor 100 under the control of the light emission control signal in a light-emitting phase such that the light-emitting unit OLED emits light.

As shown in FIG. 1, the scan signal is provided by a gate line gate, the light emission control signal is provided by a light emission control line em, the supply voltage is provided by a power line Vdd which is connected to the power supply, the data voltage is provided by a data line data, and the reference signal is provided by a reference signal line ref.

In embodiments of the present disclosure, the supply voltage is written into the first node by the precharge sub-circuit, then the potential of the first node is decreased by the reset sub-circuit, then the data voltage is written into the first node by the data writing sub-circuit, so that the potential of the first node is equal to the sum of the data voltage and the threshold voltage of the driving transistor, and finally the power supply is connected with the light-emitting unit through the driving transistor so as to drive the light-emitting unit to emit light. Since the potential of the first node is equal to the sum Vdata+Vth of the data voltage Vdata and the threshold voltage Vth before the driving transistor is turned on, when the display device is driven by the supply voltage to emit light, the current between the first terminal and the second terminal of the driving transistor (i.e. the current flowing through the OLED) is: $Ids=K(Vgs-Vth)^2=K(Vdata+Vth-Vdd-Vth)^2=K(Vdata-Vdd)^2$. According to this formula, it can be seen that the current flowing through the OLED is not affected by the threshold voltage Vth, so that the threshold voltage Vth is compensated. In addition, during the operation of the pixel circuit, the pixel circuit can be reset by writing and decreasing the potential of the first node by the precharge sub-circuit and the reset sub-circuit. As a result, there is no need to employ a separate reset circuit to generate a reset signal for resetting.

Figure 2:
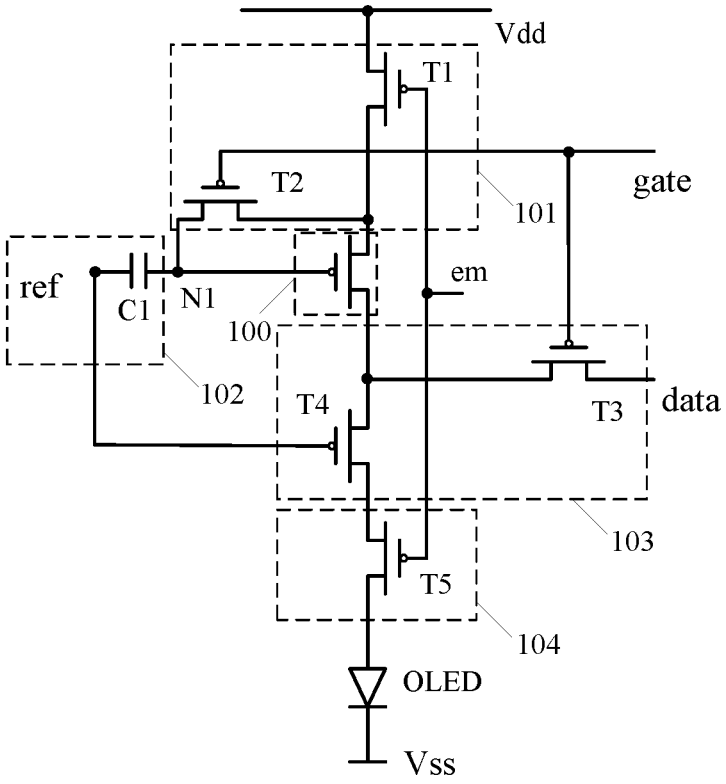
FIG. 2 is a schematic structural diagram of a specific circuit for implementing the pixel circuit provided by embodiments of the present disclosure.

Specifically, referring to FIG. 2, the precharge sub-circuit 101 may comprise a first transistor T1 and a second transistor T2. A control terminal of the first transistor T1 is connected to the light emission control line em, a first terminal of the first transistor T1 is connected to the power line Vdd, and a second terminal of the first transistor T1 is connected to a first terminal of the driving transistor 100. A control terminal of the second transistor T2 is connected to the gate line gate, a first terminal of the second transistor T2 is connected to the first terminal of the driving transistor 100, and a second terminal of the second transistor T2 is connected to the control terminal of the driving transistor 100. The precharge sub-circuit 101 controls T1 via the light emission control signal outputted by the light emission control line em, and controls T2 via the scan signal outputted by the gate line gate. T1 and T2 are turned on to input the supply voltage, and the potential of the first node N1 is Vdd.

Referring to FIG. 2, the reset sub-circuit 102 may comprise a capacitor C1, one pole of the capacitor C1 is connected to the control terminal of the driving transistor 100, and the other pole of the capacitor C1 is connected to the reference signal line ref. The reset sub-circuit 102 decreases a potential of the other pole of C1 (which is decreased from VGH to V1) via the reference signal. Due to the bootstrap effect of the capacitor C1, the potential of the one pole of C1 is decreased (which is decreased from Vdd to Vdd+V1−VGH), thereby decreasing the potential of the first node N1.

Referring to FIG. 2, the data writing sub-circuit 103 may comprise a third transistor T3 and a fourth transistor T4. A control terminal of the third transistor T3 is connected to the gate line gate, a first terminal of the third transistor T3 is connected to the data line data, and a second terminal of the third transistor T3 is connected to a second terminal of the driving transistor 100. A control terminal of the fourth transistor T4 is connected to the reference signal line ref, a first terminal of the fourth transistor T4 is connected to the second terminal of the driving transistor 100, and a second terminal of the fourth transistor T4 is connected to the light emission control sub-circuit 104. The data writing sub-circuit 103 controls the third transistor T3 to be turned on via the scan signal outputted by the gate line gate and controls a fifth transistor T5 to be turned off via the light emission control signal outputted by the light emission control line em, thereby ensuring charging. During charging, T2 and the driving transistor 100 form a diode connection, respectively. In this case, the potential of the first node N1 is a low level Vdd+V1−VGH, and the data signal reaches the second terminal of the driving transistor 100 through T3. Since the voltage Vdata of the data signal is at a high potential, the driving transistor 100 is turned on in a reverse direction, and Vdata is charged into the first node N1 through T2. When the potential of the first node N1 reaches Vdata+Vth, the driving transistor 100 is turned off, and charging is finished.

Referring to FIG. 2, the light emission control sub-circuit 104 comprises the fifth transistor T5. A control terminal of the fifth transistor T5 is connected to the light emission control line em, a first terminal of the fifth transistor T5 is connected to the second terminal of the fourth transistor T4, and a second terminal of the fifth transistor T5 is connected to the light-emitting unit OLED. The light emission control sub-circuit 104 controls the first transistor T1 and the fifth transistor T5 to be turned on via the light emission control signal outputted by the light emission control line em. A potential of the first terminal of T3 is higher than that of the control terminal of T3, then T3 is turned on. After T3 is turned on, a potential of the first terminal of the driving transistor 100 is higher than that of the control terminal of the driving transistor 100, then the driving transistor 100 is turned on. At that time, T1, T4, the driving transistor 100 and T5 are all turned on, so that the power supply is connected with the light-emitting unit.

Referring to FIG. 2, one terminal of the light-emitting unit OLED is connected to a high voltage Vdd through T1, T4, the driving transistor 100 and T5, and the other terminal of the light-emitting unit OLED is connected to a low voltage Vss, so that the light-emitting unit OLED emits light under the effect of Vdd and Vss.

In an example implementation of the embodiments of the present disclosure, a light emission control line em of a pixel circuit of an N-th row is connected to a reference signal line ref of a pixel circuit of an (N+1)-th row, which are both connected to a same output signal line of a scan driving unit, wherein N is a positive integer. The light emission control signal is different from the reference signal by one phase, thus the light emission control line em of the pixel circuit of the N-th row and the reference signal line ref of the pixel circuit of the (N+1)-th row can exactly meet the above requirement. By sharing the signal, it is possible to avoid fabricating a reference signal generation circuit separately so as to reduce the area of the circuit. The scan driving unit may be a Gate On Array (GOA) unit.

In an example implementation of the embodiments of the present disclosure, the first transistor T1, the second transistor T2, the third transistor T3, the fourth transistor T4, the fifth transistor T5, and the driving transistor 100 are thin film transistors. The thin film transistor has small size and low power consumption, and can be controlled conveniently and accurately.

Optionally, the driving transistor 100 may be a P-channel enhancement type metal oxide semiconductor field effect transistor (MOSFET), and may also be a P-type bipolar junction transistor (BJT).

Optionally, the first to fifth transistors T1-T5 may be one of a junction field effect transistor (JFET), an enhancement type MOSFET, a depletion type MOSFET and a BJT, respectively.

The preceding description of magnitudes of respective signals in the present embodiment is based on a P-type transistor. That is, the first to fifth transistors T1-T5 and the driving transistor are all P-type transistors. Certainly, embodiments of the present disclosure are not so limited. The first to fifth transistors T1-T5 and the driving transistor may also be N-type transistors. When the above transistors (the first to fifth transistors T1-T5 and the driving transistor) are P-type transistors, they are turned on when the potentials of the control terminals thereof are smaller than the potentials of the second terminals thereof, respectively. When the fifth transistor is an N-type transistor, the fifth transistor is turned on when the potential of the control terminal of the fifth transistor is higher than the potential of the second terminal of the fifth transistor.

In each cycle, the light emission control signal includes a pulse for controlling the light emission control sub-circuit 104 to connect the power supply with the light-emitting unit through the driving transistor.

In each cycle, the scan signal includes two pulses. The former of the two pulses is used to control the precharge sub-circuit 101 to write the supply voltage into the first node, and the latter is used to control the data writing sub-circuit 103 to write the data voltage into the first node. Each cycle includes the precharge phase, the reset phase, the data writing phase, and the light-emitting phase.

Accordingly, when the above transistors are P-type transistors, the scan signal includes two low-level pulses and the light emission control signal includes a high-level pulse. When the above transistors are N-type transistors, the scan signal includes two high-level pulses, and the light emission control signal includes a low-level pulse.

When the scan signal includes two low-level pulses and the light emission control signal includes a high-level pulse, the scan signal and the light emission control signal may be generated by the scan driving unit simultaneously, thereby reducing a driving signal generation circuit. The scan driving unit mainly comprises a gate shift register, and the gate shift register can generate two level signals, i.e. VGH and VGL. In embodiments of the present disclosure, the light emission control signal may be implemented using a high-level VGH, and the scan signal may be implemented using a low-level VGL (for example, a timing signal controls two low-level VGL pulses to be outputted in each cycle).

Embodiments of the present disclosure provide an array substrate comprising the pixel circuit provided in FIG. 1 or FIG. 2.

Since the array substrate provided by embodiments of the present disclosure has the same technical features as the pixel circuit described above, it can also solve the same technical problem and produce the same technical effect.

Embodiments of the present disclosure further provide a display device comprising any of the array substrates described above. The display device may be any product or component having display function such as an electronic paper, an OLED panel, a mobile phone, a tablet computer, a television, a display, a notebook computer, a digital photo frame, a navigator and the like.

Since the display device provided by embodiments of the present disclosure has the same technical features as any of the array substrates described above, it can also solve the same technical problem and produce the same technical effect.

Figure 3:
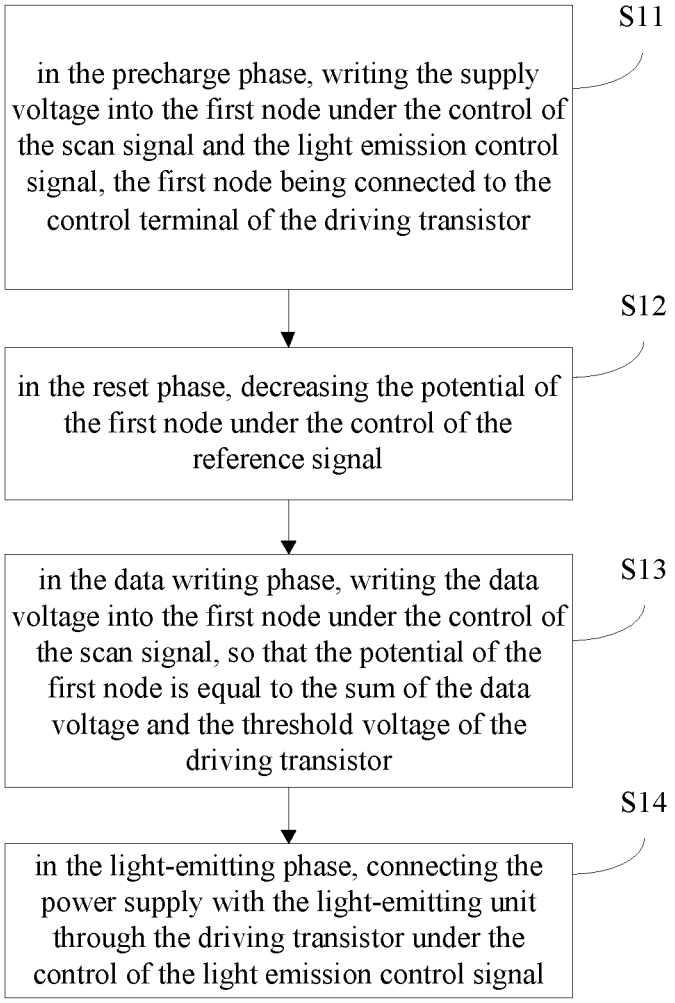
FIG. 3 is a flow chart of a pixel circuit driving method provided by embodiments of the present disclosure.

FIG. 3 is a flow chart of a pixel circuit driving method provided by embodiments of the present disclosure for driving the pixel circuit shown in FIG. 1. Referring to FIG. 3, the method comprises:

Step S11: in the precharge phase, writing the supply voltage into the first node under the control of the scan signal and the light emission control signal, the first node being connected to the control terminal of the driving transistor;

Step S12: in the reset phase, decreasing the potential of the first node under the control of the reference signal;

Step S13: in the data writing phase, writing the data voltage into the first node under the control of the scan signal so that the potential of the first node is equal to the sum of the data voltage and the threshold voltage of the driving transistor; Step S14: in the light-emitting phase, connecting the power supply with the light-emitting unit through the driving transistor under the control of the light emission control signal.

In embodiments of the present disclosure, a light emission control signal of a pixel circuit of an N-th row and a reference signal of a pixel circuit of an (N+1)-th row are the same signal, wherein N is a positive integer. The light emission control signal is different from the reference signal by one phase, thus the light emission control signal of the pixel circuit of the N-th row and the reference signal of the pixel circuit of the (N+1)-th row can be implemented exactly using the same signal. By sharing the signal, it is possible to avoid fabricating a reference signal generation circuit separately, so as to reduce the area of the circuit.

Figure 4:
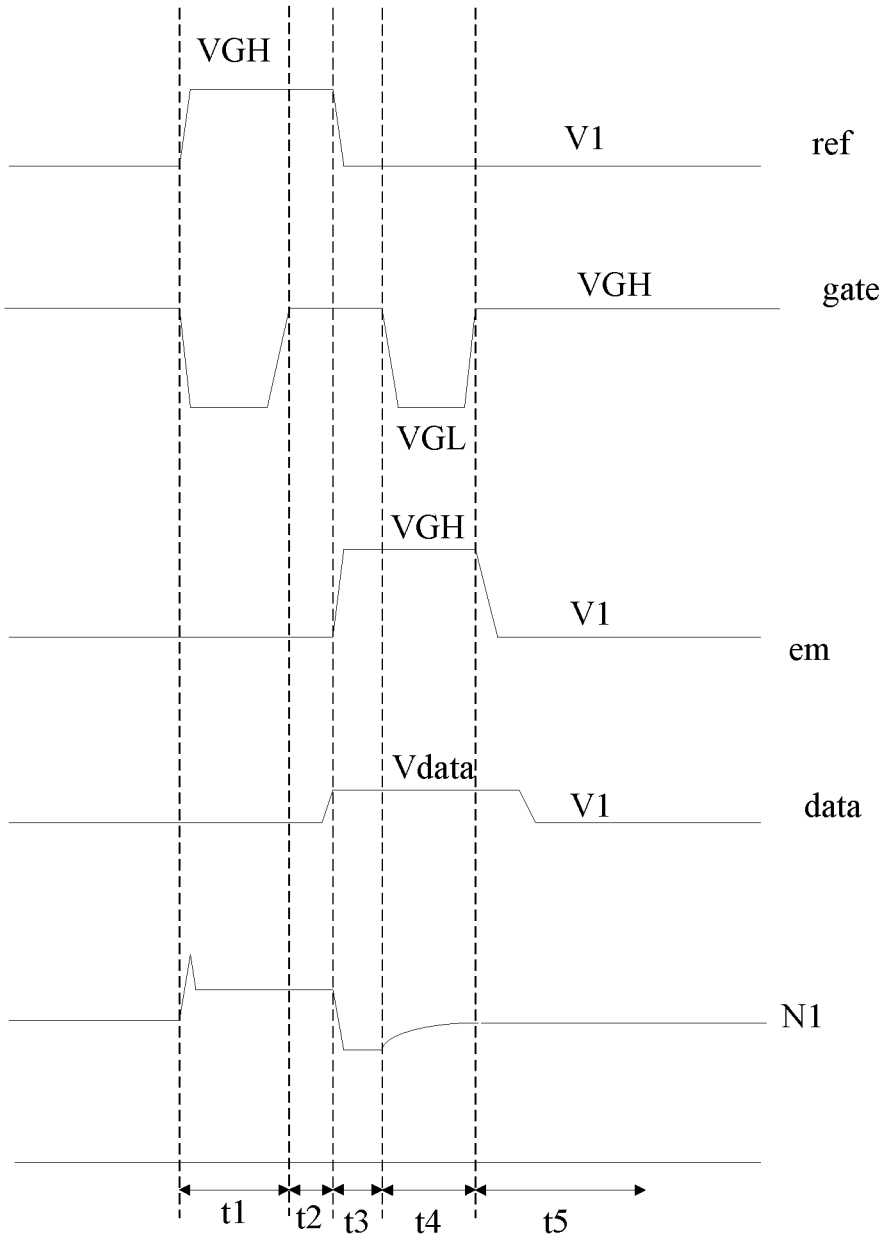
FIG. 4 is a timing diagram of control signals of the pixel circuit provided by embodiments of the present disclosure.

FIG. 4 is a timing diagram of control signals of a pixel circuit provided by embodiments of the present disclosure. It is to be noted that the timing diagram shown in FIG. 4 is based on the example in which the transistors are P-type transistors. The present disclosure is not so limited.

As shown in FIG. 4, the timing of control signals of the pixel circuit includes a precharge phase t1+t2, a reset phase t3, a data writing phase t4, and a light-emitting phase t5.

During the precharge phase t1, the reference signal is at a high level VGH, the scan signal is at a low level VGL, the light emission control signal is at a low level VGL, and the data voltage is at a low level V1. In this case, the first transistor T1 and the second transistor T2 are turned on, the supply voltage Vdd is written into the first node N1, and the driving transistor 100 is turned off. In addition, the fourth transistor T4 is turned off, and the data voltage would not be written into the other pole of the capacitor C1 (one pole accessed with the reference signal).

During the precharge phase t2, the scan signal jumps to a high level VGH. In this case, the second transistor T2 is turned off, and a potential of one terminal of the first node N1 is maintained at the high potential Vdd under the effect of the capacitor C1.

During the reset phase t3, the reference signal jumps to a low level V1. In this case, a potential of the other pole of the capacitor C1 decreases from VGH to V1. Accordingly, the potential of the one pole of the capacitor C1 also decreases from Vdd to Vdd+V1−VGH due to the bootstrap effect of the capacitor C1. The light emission control signal jumps to a high potential VGH. Therefore, the first transistor T1 and the third transistor T3 are turned off, and the data voltage jumps from V1 to a high potential Vdata.

During the data writing phase t4, the scan signal jumps from VGH to VGL. In this case, the second transistor T2, the third transistor T3 and the driving transistor 100 are turned on, and the second transistor T2 and the driving transistor 100 form a diode connection respectively. Since the potential of the second terminal of the driving transistor 100 is higher than that of the first terminal of the driving transistor 100, the driving transistor 100 is turned on in a reverse direction, and the data voltage is written into the node N1. When the potential of the first node N1 reaches Vdata+Vth, the driving transistor 100 is turned off.

During the light-emitting phase t5, the scan signal jumps from VGL to VGH, the light emission control signal jumps from VGH to VGL, the first transistor T1, the driving transistor 100, the fourth transistor T4 and the fifth transistor T5 are turned on, and the second transistor T2 and the third transistor T3 are turned off, the potential of the first node N1 is unchanged, and the power supply is connected with the light-emitting unit OLED through the driving transistor 100. At that time, the current of the driving transistor 100 is:

$Ids=K(Vgs-Vth)^2=K(Vdata+Vth-Vdd-Vth)^2=K(Vdata-Vdd)^2$. According to this formula, it can be seen that the current flowing through the OLED is not affected by the threshold voltage Vth.

As shown in FIG. 4, in each cycle, the scan signal includes two pulses. The former of the two pulses is used to control the precharge sub-circuit to write the supply voltage into the first node, and the latter of the two pulses is used to control the data writing sub-circuit to write the data voltage into the first node. Each cycle includes the precharge phase, the reset phase, the data writing phase and the light-emitting phase.

As shown in FIG. 4, the scan signal may include two low-level pulses.

Since the pixel circuit driving method provided by embodiments of the present disclosure has technical features corresponding to those of any of the pixel circuits described above, it can also solve the same technical problem and produce the same technical effect.

Those ordinarily skilled in the art should understand that all or part of the steps for implementing the foregoing embodiments may be carried out by hardware or by instructing relevant hardware through a program. The program may be stored in a computer-readable storage medium. The storage medium mentioned may be a read-only memory, a magnetic disk or an optical disk, etc.

The embodiments described above are merely exemplary embodiments of the present disclosure and are not used to limit the present disclosure. Any modifications, equivalent substitutions, improvements, and the like made within the spirit and principle of the present disclosure should be included in the protection scope of the present disclosure.

The invention claimed is:

1. A pixel circuit comprising:

a driving transistor;

a precharge sub-circuit configured to write a supply voltage into a first node under the control of a scan signal and a light emission control signal in a precharge phase, the first node being connected to a control terminal of the driving transistor;

a reset sub-circuit configured to decrease a potential of the first node under the control of a reference signal in a reset phase;

a data writing sub-circuit configured to write a data voltage into the first node under the control of the scan signal in a data writing phase, so that the potential of the first node is equal to a sum of the data voltage and a threshold voltage of the driving transistor;

a light emission control sub-circuit configured to connect a power supply with a light-emitting unit through the driving transistor under the control of the light emission control signal in a light-emitting phase;

wherein the data writing sub-circuit comprises a third transistor and a fourth transistor, a control terminal of the third transistor being connected to a gate line, a first terminal of the third transistor being connected to a data line, a second terminal of the third transistor being connected to a second terminal of the driving transistor, a control terminal of the fourth transistor being connected to a reference signal line, a first terminal of the fourth transistor being connected to the second terminal of the driving transistor, a second terminal of the fourth transistor being connected to the light emission control sub-circuit, the data line being configured to output the data voltage.

2. The pixel circuit according to claim 1, wherein the precharge sub-circuit comprises a first transistor and a second transistor, a control terminal of the first transistor being connected to a light emission control line, a first terminal of the first transistor being connected to a power line, a second terminal of the first transistor being connected to a first terminal of the driving transistor, a control terminal of the second transistor being connected to a gate line, a first terminal of the second transistor being connected to the first terminal of the driving transistor, a second terminal of the second transistor being connected to the control terminal of the driving transistor, the light emission control line being configured to output the light emission control signal, the power line being configured to output the supply voltage of the power supply, the gate line being configured to output the scan signal.

3. The pixel circuit according to claim 1, wherein the reset sub-circuit comprises a capacitor, one pole of the capacitor being connected to a control terminal of the driving transistor, the other pole of the capacitor being connected to a reference signal line, the reference signal line being configured to output the reference signal.

4. The pixel circuit according to claim 1, wherein the light emission control sub-circuit comprises a fifth transistor, a control terminal of the fifth transistor being connected to a light emission control line, a first terminal of the fifth transistor being connected to the second terminal of the fourth transistor, a second terminal of the fifth transistor being connected to the light-emitting unit.

5. The pixel circuit according to claim 1, wherein the precharge sub-circuit comprises a first transistor and a second transistor, a control terminal of the first transistor being connected to a light emission control line, a second terminal of the first transistor being connected to a power line, a second terminal of the first transistor being connected to a first terminal of the driving transistor, a control terminal of the second transistor being connected to a gate line, a first terminal of the second transistor being connected to the first terminal of the driving transistor, a second terminal of the second transistor being connected to the control terminal of the driving transistor, the light emission control line being configured to output the light emission control signal, the power line being configured to output a supply voltage of the power supply, the gate line being configured to output the scan signal;

the reset sub-circuit comprises a capacitor, one pole of the capacitor being connected to the control terminal of the driving transistor, the other pole of the capacitor being connected to a reference signal line, the reference signal line being configured to output the reference signal;

the data writing sub-circuit comprises a third transistor and a fourth transistor, a control terminal of the third transistor being connected to the gate line, a first terminal of the third transistor being connected to a data line, a second terminal of the third transistor being connected to a second terminal of the driving transistor, a control terminal of the fourth transistor being connected to the reference signal line, a first terminal of the fourth transistor being connected to the second terminal of the driving transistor, a second terminal of the fourth transistor being connected to the light emission control sub-circuit, the data line being configured to output the data voltage; and the light emission control sub-circuit comprises a fifth transistor, a control terminal of the fifth transistor being connected to the light emission control line, a first terminal of the fifth transistor being connected to the second terminal of the fourth transistor, a second terminal of the fifth transistor being connected to the light-emitting unit.

6. The pixel circuit according to claim 5, wherein the first transistor, the second transistor, the third transistor, the fourth transistor, the fifth transistor, and the driving transistor are thin films transistors.

7. The pixel circuit according to claim 1, wherein in each cycle, the scan signal includes two pulses, the former of the two pulses being configured to control the precharge sub-circuit to write the supply voltage into the first node, the latter of the two pulses being configured to control the data writing sub-circuit to write the data voltage into the first node, said each cycle including the precharge phase, the reset phase, the data writing phase, and the light-emitting phase.

8. The pixel circuit according to claim 1, wherein in each cycle, the light emission control signal includes one pulse, the pulse being configured to control the light emission control sub-circuit to connect the power supply with the light-emitting unit through the driving transistor, said each cycle including the precharge phase, the reset phase, the data writing phase, and the light-emitting phase.

9. An array substrate, comprising multiple rows of pixel circuits according to claim 1.

10. The array substrate according to claim 9, wherein a light emission control line of a pixel circuit of an N-th row is connected to a reference signal line of a pixel circuit of an (N+1)-th row, N being a positive integer.

11. A display device, comprising the array substrate according to claim 9.

12. A pixel circuit driving method for driving the pixel circuit according to claim 1, the method comprising:

in the precharge phase, writing the supply voltage into the first node under the control of the scan signal and the light emission control signal, the first node being connected to the control terminal of the driving transistor;

in the reset phase, decreasing the potential of the first node under the control of the reference signal;

in the data writing phase, writing the data voltage into the first node under the control of the scan signal, so that the potential of the first node is equal to the sum of the data voltage and the threshold voltage of the driving transistor;

in the light-emitting phase, connecting the power supply with the light-emitting unit through the driving transistor under the control of the light emission control signal.

13. The method according to claim 12, wherein in each cycle, the scan signal includes two pulses, the former of the two pulses being configured to write the supply voltage into the first node, the latter of the two pulses being configured to write the data voltage into the first node, said each cycle including the precharge phase, the reset phase, the data writing phase, and the light-emitting phase.

14. An array substrate driving method for driving the array substrate according to claim 9, the method comprising driving the pixel circuits of the array substrate row by row using the method according to claim 12.

15. The method according to claim 14, wherein a light emission control signal of a pixel circuit of an N-th row and a reference signal of a pixel circuit of an (N+1)-th row are the same signal, N being a positive integer.

16. The method according to claim 14, wherein in each cycle, the scan signal includes two pulses, the former of the two pulses being configured to write the supply voltage into the first node, the latter of the two pulses being configured to write the data voltage into the first node, said each cycle including the precharge phase, the reset phase, the data writing phase, and the light-emitting phase.

17. The array substrate according to claim 9, wherein the precharge sub-circuit comprises a first transistor and a second transistor, a control terminal of the first transistor being connected to a light emission control line, a first terminal of the first transistor being connected to a power line, a second terminal of the first transistor being connected to a first terminal of the driving transistor, a control terminal of the second transistor being connected to a gate line, a first terminal of the second transistor being connected to the first terminal of the driving transistor, a second terminal of the second transistor being connected to the control terminal of the driving transistor, the light emission control line being configured to output the light emission control signal, the power line being configured to output the supply voltage of the power supply, the gate line being configured to output the scan signal.

18. The array substrate according to claim 9, wherein the reset sub-circuit comprises a capacitor, one pole of the capacitor being connected to a control terminal of the driving transistor, the other pole of the capacitor being connected to a reference signal line, the reference signal line being configured to output the reference signal.

19. The array substrate according to claim 9, wherein the data writing sub-circuit comprises a third transistor and a fourth transistor, a control terminal of the third transistor being connected to a gate line, a first terminal of the third transistor being connected to a data line, a second terminal of the third transistor being connected to a second terminal of the driving transistor, a control terminal of the fourth transistor being connected to a reference signal line, a first terminal of the fourth transistor being connected to the second terminal of the driving transistor, a second terminal of the fourth transistor being connected to the light emission control sub-circuit, the data line being configured to output the data voltage.

* * * * *